United States Patent [19]

Glendinning

[11] Patent Number: 5,074,502

[45] **Date of Patent: * Dec. 24, 1991**

[54] UNIVERSAL TABLE BASE

[76] Inventor: Scott Glendinning, 5515 Doyle St., #2, Emeryville, Calif. 94608

[ * ] Notice: The portion of the term of this patent subsequent to Apr. 25, 2006 has been disclaimed.

[21] Appl. No.: 511,246

[22] Filed: Apr. 19, 1990

[51] Int. Cl.[5] ..... F16M 11/20

[52] U.S. Cl. ..... 248/164; 248/188.1

[58] Field of Search ..... 248/164, 165, 188.1; 211/176, 177, 178, 182

[56] References Cited

U.S. PATENT DOCUMENTS

| | | | |
|---|---|---|---|
| 516,562 | 3/1894 | Burr | 248/165 |
| 1,273,840 | 7/1918 | Fassett | 248/165 |
| 1,320,611 | 11/1919 | Forester | 248/165 |
| 3,396,933 | 8/1968 | Ward | 248/165 |
| 4,433,843 | 2/1984 | Bricco | 248/165 X |
| 4,440,812 | 4/1984 | Norrid | 248/165 X |
| 4,532,910 | 8/1985 | Longley, Jr. | 248/165 X |
| 4,540,308 | 9/1985 | Colby | 248/188.1 X |
| 4,824,058 | 4/1989 | Glendinning . | |
| 4,854,531 | 8/1989 | Esposito | 248/165 |

*Primary Examiner*—Gary L. Smith
*Assistant Examiner*—Michael J. Milano
*Attorney, Agent, or Firm*—Bielen, Peterson & Lampe

[57] ABSTRACT

A support member for a platform such as a table which may be of universal construction. The support member includes an axially elongated member with a pair of slots which face outwardly from the elongated member in opposite directions. Each slot includes a floor and a wall portion which extends along the elongated member. The slots extend along axes which lie in planes that are selectively orthogonally oriented relative to the axis of the elongated member or non-orthogonally oriented relative to the axis of the elongated member.

8 Claims, 4 Drawing Sheets

FIG-4
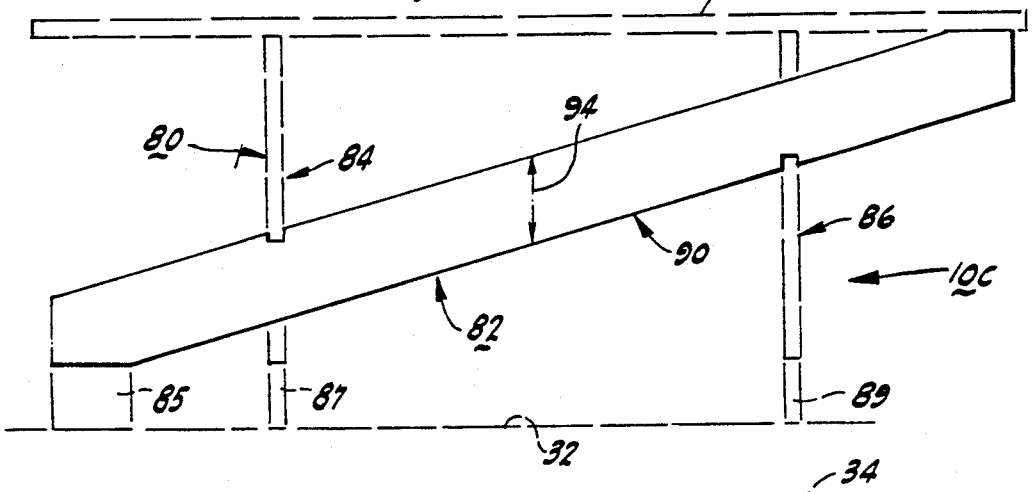
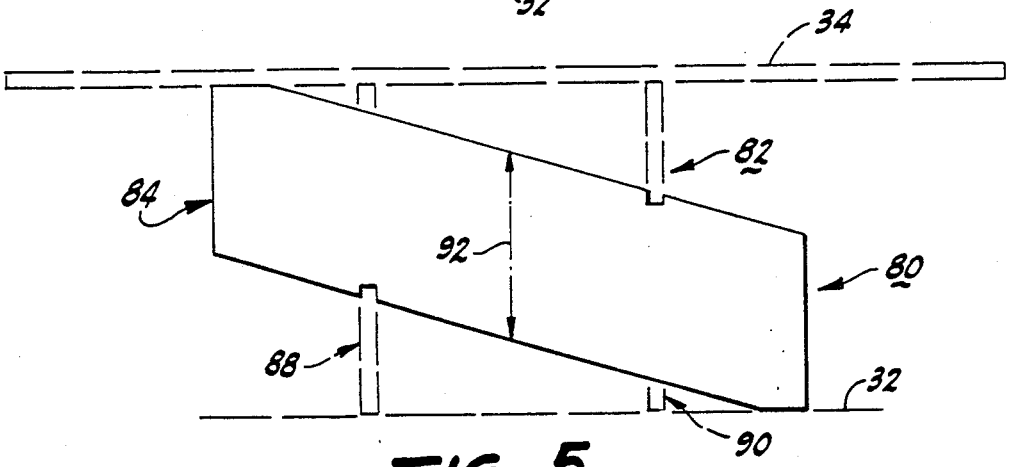
FIG-5
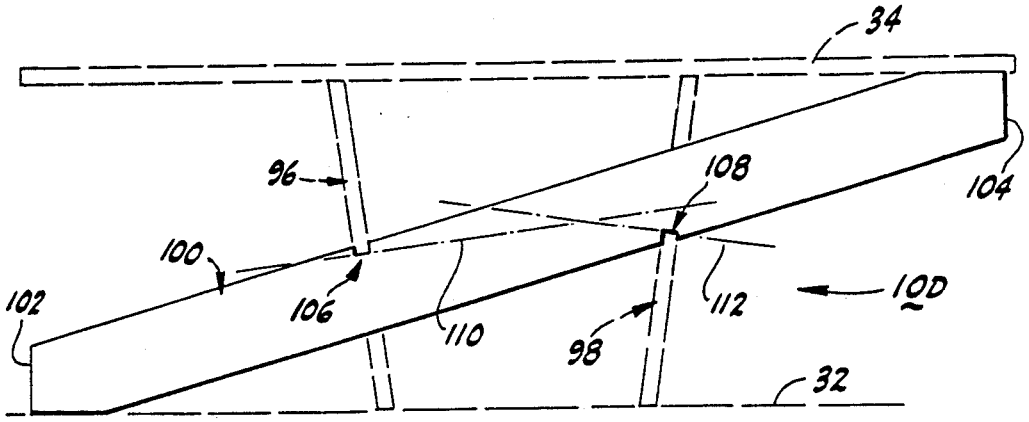
FIG-6

UNIVERSAL TABLE BASE

BACKGROUND OF THE INVENTION

The present invention relates to a novel support member for a platform such as a table which may be of universal construction. The mobility of furniture is often hampered by shear bulkiness in its construction. For example, certain tables are very difficult to transport from one site to another without the aid of several persons and, in some cases, alterations being performed to the edifice or structure housing the table.

Furniture which may be disassembled or collapsed possesses the distinct advantage of being easy to transport and store, in this regard. Many intricate collapsible furniture designs have been proposed which have proved to be unwieldy and impracticable for general usage.

Reference is made to U.S. Pat. No. 4,824,058 which described a platform or a table base having a universal member which achieves many of the objectives and solved many problems encountered in the prior art with collapsible furniture.

A support for a table or platform which further overcomes the disadvantages within the prior art would be a great advance in the field of equipment and furniture.

SUMMARY OF THE INVENTION

In accordance with the present invention a novel and useful support member capable of being assembled with like members into a base for a platform is herein provided.

The universal support structure of the present invention includes an elongated member which extends along an axis. The elongated member includes a transverse thickness dimension along the axis. First and second opposite side portions of the elongated member also extend parallel to the axis and terminate in first and second ends, respectively. Opposite edge surfaces separate the first and second side portions and first and second end portions of the elongated member.

The elongated member of the present invention includes a first slot having a floor portion which may be of flat configuration. The first slot also includes a wall portion which extends from the floor portion resulting in a depth dimension along the wall portion. The transverse distance along the floor portion of the slot is at least equal to the transverse thickness dimension of the elongated member relative to its axis. The first slot is open toward the first side portion of the elongated member. Similarly second slot including a floor portion and a wall portion is cut through and, thus, is open toward the opposite second side portion of the elongated member. The second slot may include a flat floor portion and possesses a second depth dimension along the wall portion of the same. The first and second slots may be positioned equidistantly from the first and second ends or may lie a respective similar distance from the first and second axis of the elongated member. In addition, the floor portions of the first and second slots may be substantially parallel to each other or lie in planes that intersect one another. In addition, the floor portions of the first and second slots may be co-planar. Moreover, the first and second slots may lie along axes that are orthogonally or non-orthogonally oriented with respect to the elongation member axis. Further, the first and second depth dimensions of the first and second slots may be identical or dissimilar. In this regard, certain embodiments of the elongated member of the present invention may take the form of a universal member, identical to other members for assemblage into a platform support. Other embodiments externalize in identical elongated members which are not of universal design. It should be noted that the elongated member hereinbefore described may be combined with three or more elongated members to form a platform support.

In certain cases, elongated members of similar construction must be assembled in a particular order or orientation, unlike the universal version of the present invention. Also, one embodiment of the present invention entails provision of a pair of elongated members which are not similarly constructed. The first elongated member, in this case would possess the oppositely facing slots on opposite side portions found in the prior embodiments. Such slots would lie in axes and be oriented in a non-orthogonal manner relative to the axes of the elongated member. In other words, slots are angularly cut relative to the edges of the elongated member. Also, a pair of elongated members are also included each having outwardly facing open slots on opposite side portions of the elongated member. However, such pair of elongated members would include one slot which is orthogonally oriented to the axis of the elongated member and another slot which is non-orthogonally oriented thereto. Assemblage of this unit would constitute interlocking of three members into a support for a platform or table.

Each of the elongated members heretofore described include first and second surfaces positioned adjacent to the first and second ends thereof. The end surfaces appear as mitered portions of the elongated member and serve to offer positive contact with the base surface or the platform surface supported above the base surface. In the case of the universal elongated member, such first and second surfaces are interchangeable in this regard.

It may be apparent that a novel and useful support structure for a platform has been described.

It is therefore an object of the present invention to provide a support structure for a platform which is collapsible into individual elongated members and easily transported from site to site for reassembly.

It is another object of the present invention to provide a support structure or platform which employs a plurality of elongated members that are of universal construction, thus facilitating manufacture and assembly of the same.

Another object of the present invention is to provide a support structure for a platform which employs three or more elongated members which may or may not be of universal construction, but are easily assembled and disassembled.

Yet another of the present invention is to provide a support structure for a platform which includes a number of individual elements that are easily assembled and disassembled, providing a sturdy support structure in the assembled condition.

The invention possesses other objects and advantages especially as concerns particular characteristics and features thereof which will become apparent as the specification continues.

BRIEF DESCRIPTION OF THE DRAWINGS

FIG. 4 is a side elevational view of a third embodiment of the present invention depicting a variation of all the embodiments herein, in phantom.

FIG. 5 is a side elevational view of the third embodiment shown in FIG. 4.

FIG. 6 is a side elevational view of a fourth embodiment of the present invention employing a universal elongated member.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof should be taken in conjunction with the above described drawings.

Figure 1:
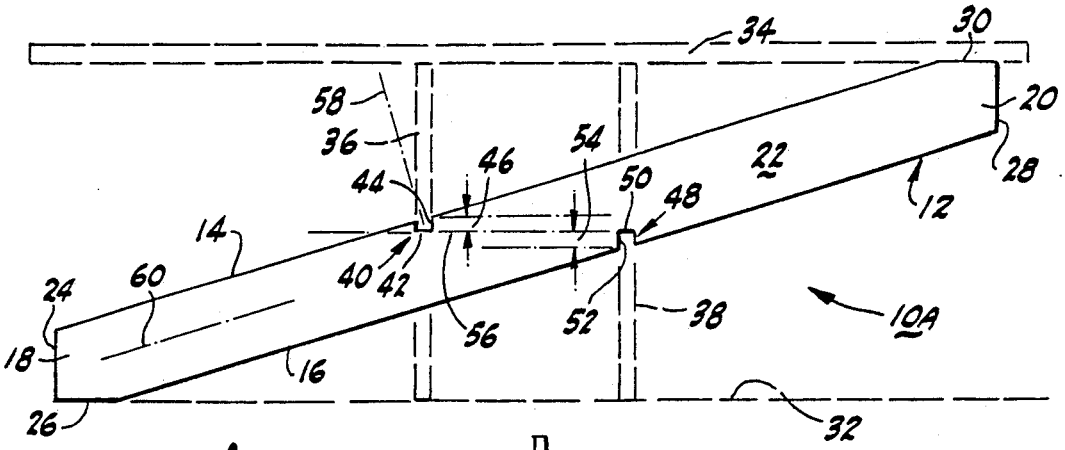
FIG. 1 is a side elevational view of a first embodiment of the present invention employing a universal member.

The invention as a whole as depicted in the drawings by reference character 10 and an upper case letter to distinguish various embodiments being described. In FIG. 1, the support structure 10A is shown which includes an elongated member 12 of universal construction having first side portion 14 and second side portion 16. Ends 18 and 20 are found at the termination of side portions 14 and 16. A flat surface 22 serves as an edge portion between sides 14 and 16. A similar edge portion (not shown) is positioned oppositely to edge portion 22 on elongated member 12. Ends 18 and 20 also include surfaces 24, 26, 28, and 30. Surfaces 26 and 30 may either serve to contact ground surface 32 or to support platform 34, both in phantom on FIG. 1. It should be apparent that elongated member is a universal member and that a quartet of the same may be assembled in any order or orientation to support platform 34 above ground surface 32. Identical elongated members 36 and 38 are depicted in phantom on FIG. 1 to form such an assembly.

Elongated member 12, and elongated members 36 and 38 and another not shown, include a first slot 40 having a floor portion 42 and a wall portion 44. Floor portion 42 and wall portion 44 are depicted as being flat and extending from flat edge 22 to the opposite edge of member 12. Thus, the transverse distance along floor 42 is at least equal to the thickness along side 14 or 16 of the elongated member 12. Such transverse dimension or thickness is better shown on members 36 and 38 of FIG. 1. First slot 40 is open toward side portion 14 of elongated member 12 and possesses a depth dimension 46 measured along wall 44, thereof.

Second slot 48 of member 12 is also included and possesses a floor portion 50 and a wall portion 52. Again, the transverse distance along floor portion 50 is at least equal to the thickness dimension across either side 14 or 16, thereof. Second slot 48 is open toward side portion 16 of elongated member 12 and includes a depth dimension 54 measured along wall portion 52. It should be noted that depth dimension 46 and depth dimension 54 are dissimilar. In addition, slots 40 and 48 are positioned equidistantly from end surfaces 24 and 28, respectively. Further, floor portions 40 and 50 of slots 40 and 48 are co-planar lying in plane 56. It should be apparent, that slots 42 and 48 are cut through elongated member 12 at right angles to edge 22 and thus are orthogonally oriented relative to edge 22. In other words, axis 56 which extends along floor 42 of slot 40 lies in a plane 58 which is orthogonally oriented relative to axis 60 of elongated member 12. Likewise, floor 50 of slot 48 extends along an axis which lies in a plane that is orthogonally oriented relative axis 60 of elongated member 12.

Figure 2:
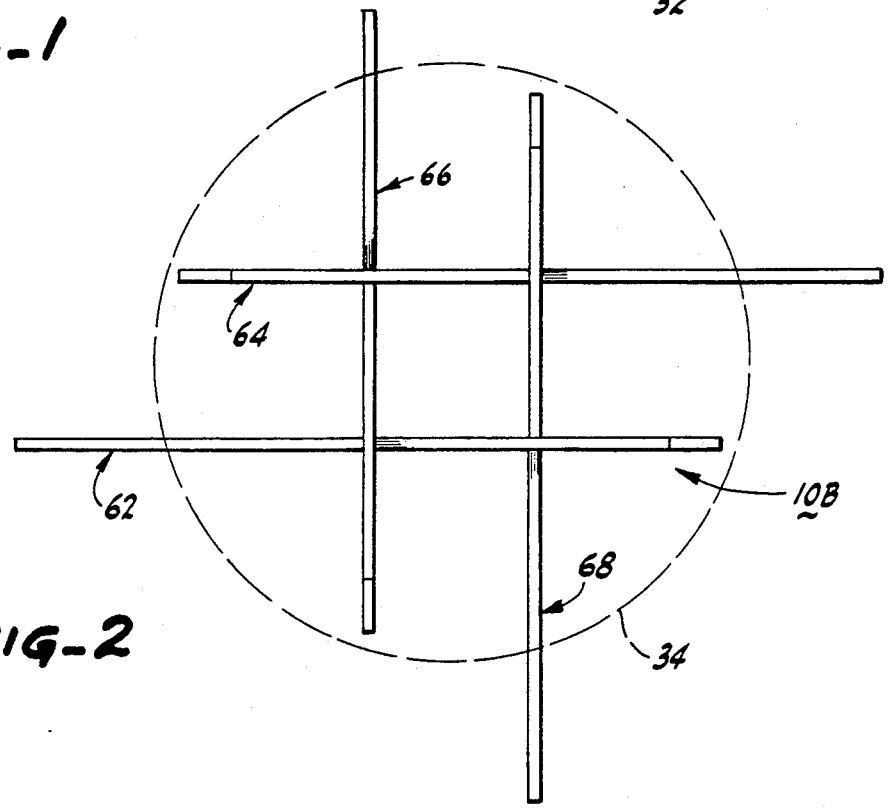
FIG. 2 is a top plan view of a second embodiment of the present invention utilizing a quartet of elongated members which are similarly constructed but not of universal construction.
Figure 3:
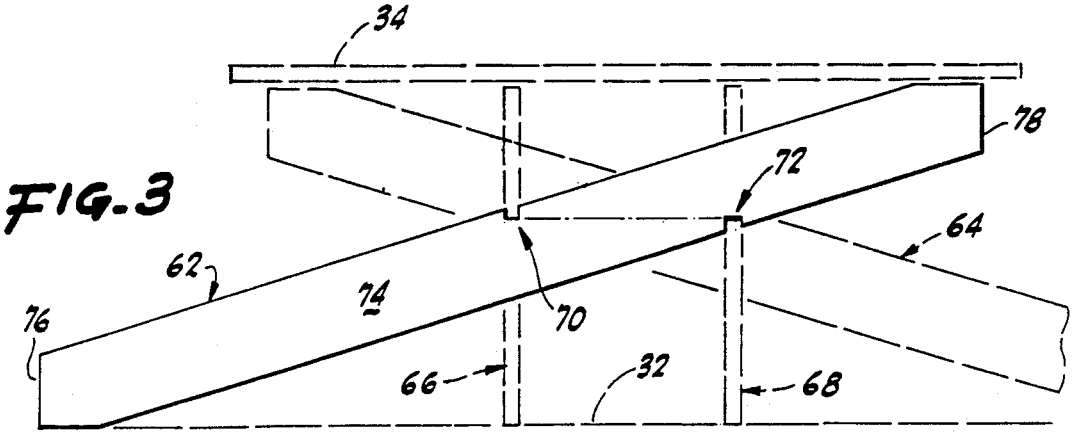
FIG. 3 is a side elevational view of an assemblage of the second embodiment depicted in FIG. 2.

Turning to FIGS. 2 and 3, another embodiment of the present invention 10B is depicted. Structure 10B includes elongated members 62, 64, 66, and 68 which are identical in construction and are depicted in FIGS. 2 and 3 as being assembled into a support to hold platform 34. With reference to FIG. 3, it may be observed that elongated member 62 includes a pair of oppositely facing slots 70 and 72 which are orthogonally oriented relative to edge surface 74. However, slots 70 and 72 are not equidistant from and edge surfaces 76 and 78, as is the case with the embodiment 10A depicted in FIG. 1. Thus, the elongated members 62, 64, 66, and 68 of embodiment 10B are not universal, although being identical in construction.

FIGS. 4 and 5 described a third embodiment of the present invention 10C which includes pairs of elongated members 80 and 82, each pair including universal and identical elongated members. For example, pair 80 includes elongated members 84 and 86. Pair 82 includes elongated members 88 and 90. Further, elongated members 84 and 90 of pairs 80 and 82, respectively, each include a pair of slots facing toward opposite side portions which are equidistant from the end surfaces. However, elongated member 84 possesses an edge portion transverse distance 92 which is greater than the edge portion transverse distance 94 of exemplar member 90.

FIG. 4 also illustrates a variation of all the embodiments where vertical legs 85, 87, and 89 are connected to the bases of members 84, 86, 88 and 90. Vertical legs 85, 87, and 89 would increase the height of platform 34 above base surface 32.

Turning now to FIG. 6, the fourth embodiment 10D is shown in which elongated members 96, 98, 100, and another one identical thereto are illustrated. Using elongated member 100 as an example of the elongated members employed in embodiment 10D it may be observed that elongated member 100 includes a pair of oppositely facing slots which are equidistant from end surfaces 102 and 104 thereof. Slot floors 106 and 108 lie in planes 110 and 112 which intersect one another. Nevertheless, elongated member 100 is a universal elongated member and identical to the other members constituting the support structure 10D.

Figure 7:
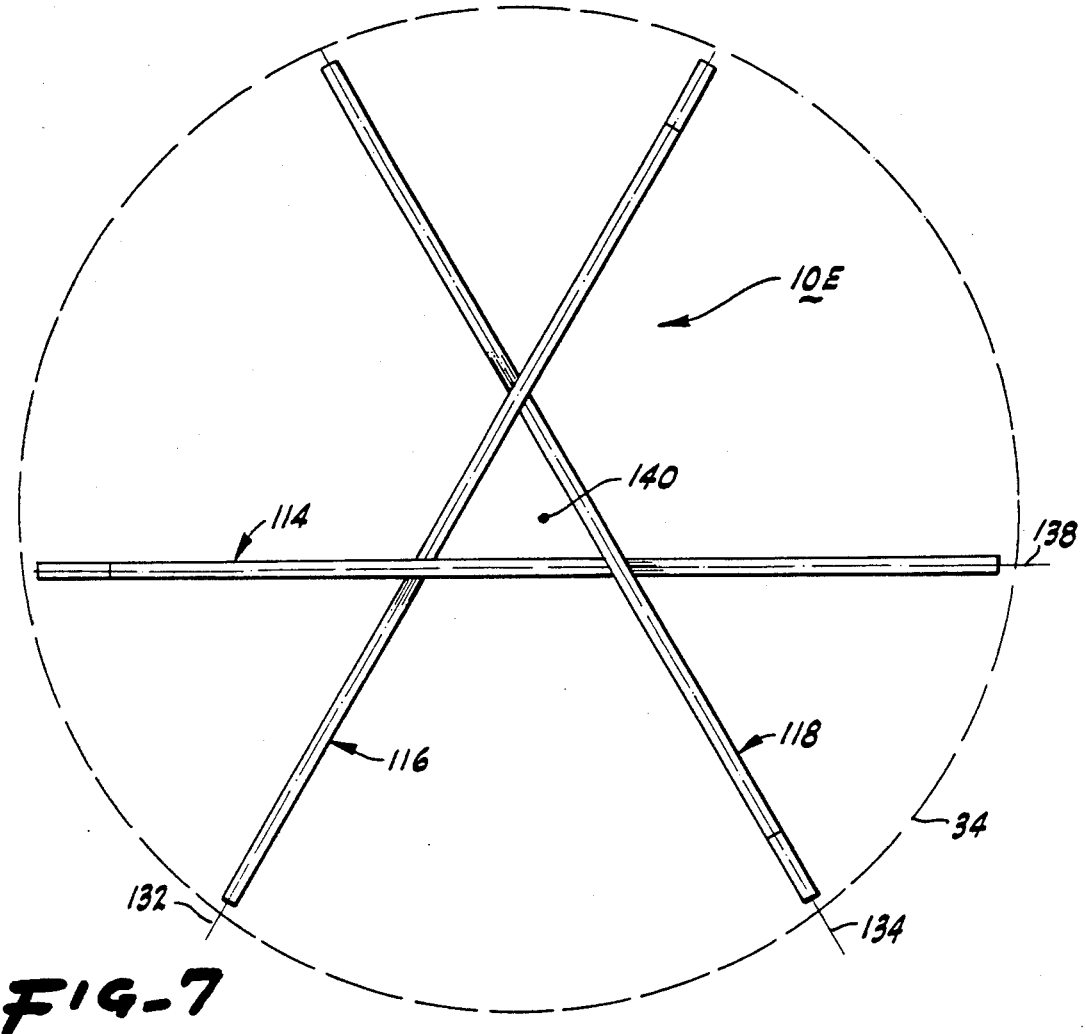
FIG. 7 is a top plan view of a fifth embodiment of the present invention utilizing a trio of elongated members each of universal construction.
Figure 8:
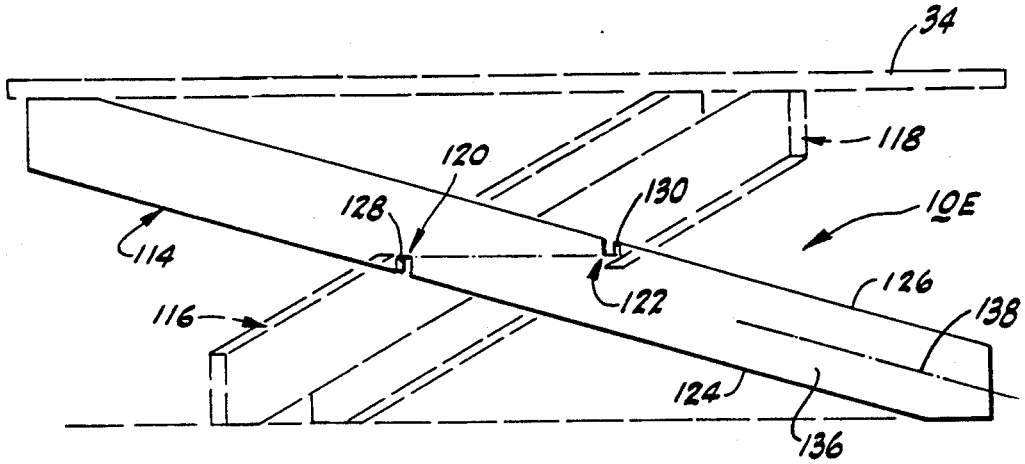
FIG. 8 is a side elevational view of the embodiment depicting in FIG. 7.

With reference to FIGS. 7 and 8, another embodiment 10E of the present invention is shown. Embodiment 10E includes identical and universal elongated members 114, 116, and 118. Embodiment 10E, thus, only requires three identical and universal members to form a structure supporting platform 34. Referring now to exemplar elongated member 114, FIG. 8, represents a pair of slots 120 and 122 found on opposite side portions 124 and 126. Slots 120 and 122 include floors 128 and 130 which are co-planar. However, slots 120 and 122 lie along axes 132 and 134 of elongated members 116 and 118, respectively, FIG. 7. As such, the axial orientation of slots 120 and 122 is not orthogonal relative to flat edge surface 136. Moreover, axes 132 and 134 do not lie in planes which are orthogonally oriented relative to axis 138 of member 114 It should be noted that central portion 140 of support structure 10E forms an equilateral triangle.

Figure 9:
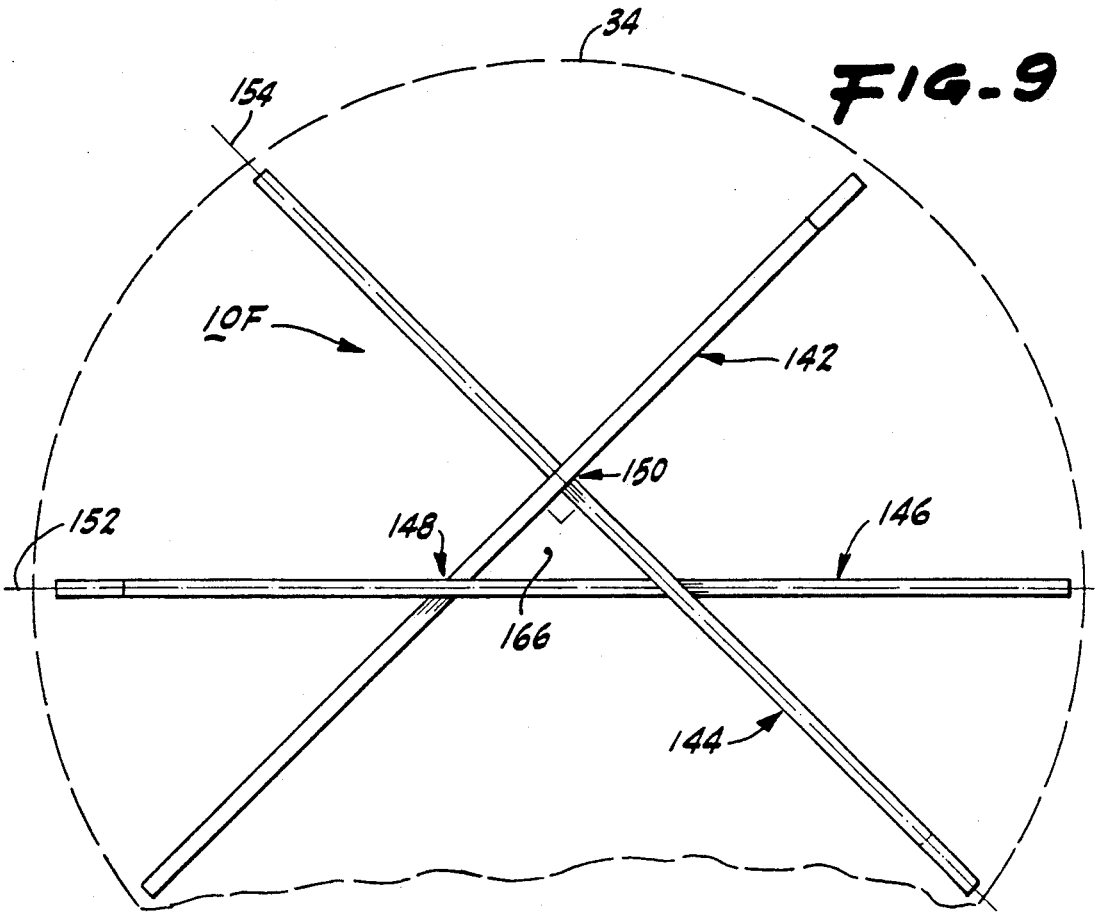
FIG. 9 is a top plan view of a sixth embodiment of the present invention utilizing a trio of elongated members.
Figure 10:
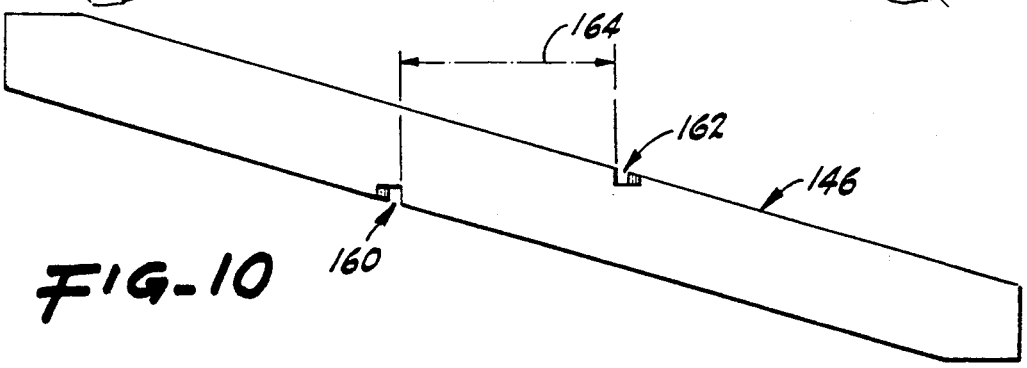
FIG. 10 is a side elevational view of one type of elongated member used in the embodiment of FIG. 9.
Figure 11:
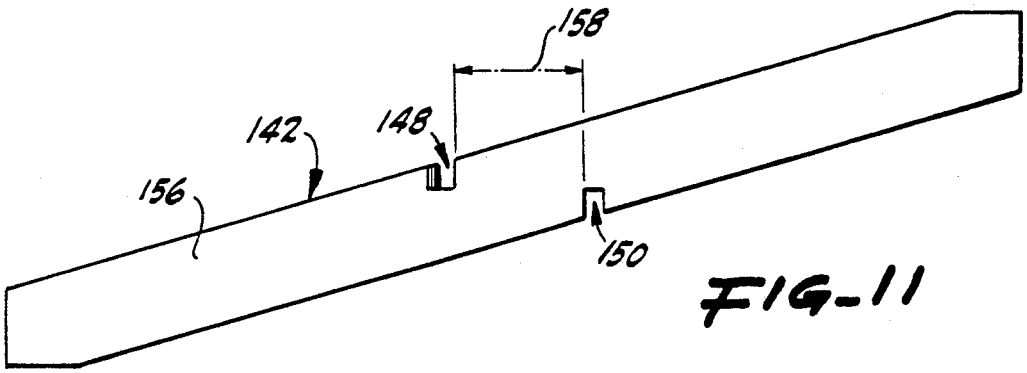
FIG. 11 is a side elevational view of another type of elongated element used in the embodiment depicted in FIG. 9.

With reference to FIGS. 9–11 the embodiment 10F is shown which employs elongated members 142 and 144, of identical configuration, and elongated member 146 which is of singular construction. FIGS. 10 and 11 depict elongated members 146 and 142. Elongated member 146 is essentially similar to elongated member 114 depicted in FIG. 8. Elongated member 142 includes a pair of slots 148 and 150 which lie along axes 152 and 154 of the elongated member 146 and 144, FIG. 9. Therefore, slot 150 is orthogonal to edge surface 156 of elongated member 142 while slot 148 lies in a non-orthogonal orientation thereto. It should be noted that the distance between slots 148 and 150, directional arrow 158, is less than the distance between slots 160 and 162 of elongated member 146, FIG. 10, directional arrow 164.

In operation, the user assembles the elongated members found in embodiments 10A–10F as depicted in the drawings by interlocking slots. Embodiment 10A, 10D, and 10E show universal members which may be assembled in any direction and are identically constructed. The members depicted in embodiment 10B, although identically constructed, must be assembled in one way as shown in FIG. 2 and 3. Embodiment 10C illustrated in FIGS. 4 and 5 show two pairs of universal members which must be assembled as shown. The embodiment 10F, FIGS. 9–11, must be assembled as shown to form a central portion 166 which takes the form of an isosceles triangle. Disassembly of all the embodiments depicted in the drawings would simply entail the reverse process of assembly, i.e. removing slot portions of particular elongated members from slot portions of other elongated members.

While in the foregoing embodiments of the invention have been set forth in considerable detail for the purposes of making a complete disclosure of the invention it may be apparent to those of ordinary skill in the art that numerous changes may be made in such details without departing from the spirit and principles of the invention.

What is claimed is:

1. A universal support structure capable of being assembled with like structures to form a base for a platform comprising:

an elongated member extending along an axis and including a transverse thickness dimension relative to said axis, said elongated member including first and second opposite side portions extending along said axis, said first and second side portions terminating in first and second ends of said elongated member, respectively, said elongated member including a first slot having a flat floor portion and one wall portion, the transverse distance along said flat floor portion being at least equal to said transverse thickness dimension of said elongated member, said first slot being open toward said first side portion of said elongated member, said first slot possessing a first depth dimension along said one wall portion thereof relative to said first side portion of said elongated member, said elongated member including a second slot having a flat floor portion and one wall portion, the transverse distance along said flat floor portion being at least equal to said thickness dimension of said elongated member, said second slot being open toward said opposite second side portion of said elongated member, said second slot possessing a second depth dimension along said one wall thereof relative to said second side portion of said elongated member, said first and second depth dimensions being dissimilar, said first and second slots being positioned equidistantly from said first and second ends of said elongated member, respectively, said first and second slot flat floor portions lying in planes which intersect said axis of said elongated member.

2. The universal support structure of claim 1 in which said substantially flat floor portions of said first and second slots are substantially parallel to each other.

3. The universal support structure of claim 1 in which said substantially flat floor portions of said first and second slots are co-planar.

4. The universal support structure of claim 1 in which said first and second flat floor portions each lie along an axis, said first and second slot axes lying in planes perpendicular to said first and second slot flat floor portions that are non-orthogonally oriented relative to said elongated member axis, said universal support structure being capable of being assembled with two other like structures.

5. A universal support structure capable of being assembled with like structures to form a base for a platform comprising:

an elongated member extending along an axis and including a transverse thickness dimension relative to said axis, said elongated member including first and second opposite side portions extending along said axis, said first and second side portions terminating in first and second ends of said elongated member, respectively, said elongated member including a first slot having a flat floor portion and one wall portion, the transverse distance along said flat floor portion being at least equal to said transverse thickness dimension of said elongated member, said first slot being open toward said first side portion of said elongated member, said first slot possessing a first depth dimension along said one wall portion thereof relative to said first side portion of said elongated member, said elongated member including a second slot having a flat floor portion and one wall portion, the transverse distance along said flat floor portion being at least equal to said thickness dimension of said elongated member, said second slot being open toward said opposite second side portion of said elongated member, said second slot possessing a second depth dimension along said one wall portion thereof relative to said second side portion of said elongated member, said first and second depth dimensions being dissimilar, said first and second slots being positioned equidistantly from said first and second ends of said elongated member, respectively, said substantially flat floor portions of said first and second slots lying in planes that intersect one another.

6. A support member capable of being assembled with like structures to form a base for a platform, comprising:

an elongated member extending along an axis having a selected length and including a transverse thickness dimension relative to said axis; said elongated member including first and second opposite side portions extending along said axis, said first and second side portions terminating in first and second ends of said elongated member, respectively, said elongated member including a first slot having a floor portion and one wall portion, the transverse distance along said floor portion being at least equal to said transverse thickness dimension of said elongated member, said first slot being open toward said first side portion of said elongated member, said first slot possessing a first depth dimension along said one wall portion thereof relative to said first side portion of said elongated member, said elongated member including a second slot having a floor portion and one wall portion, the transverse distance along said floor portion being at least equal to said thickness dimension of said elongated member, said second lost being open toward said opposite second side portion of said elongated member, said second slot possessing a second depth dimension along said one wall portion thereof relative to said second side portion of said elongated member, said elongated member additionally comprising first and second surfaces positioned adjacent said first and second ends of said elongated member, said floors of said first and second slots each lying in a plane parallel to one another, said planes of said floors of first and second slots being substantially parallel to said first and second surfaces.

7. A support structure capable of being assembled with like structures to form a base for a platform comprising:

an elongated member extending along an axis having a selected length and including a transverse thickness dimension relative to said axis, said elongated member including first and second opposite side portions extending along said axis, said first and second side portions terminating in first and second ends of said elongated member, respectively, said elongated member including a first slot having a flat floor portion and one wall portion, the transverse distance along said flat floor portion being at least equal to said transverse thickness dimension of said elongated member, said first slot being open toward said first side portion of said elongated member, said first slot possessing a first depth dimension along said one wall portion thereof relative to said first side portion of said elongated member, said elongated member including a second slot having a flat floor portion and one wall portion, the transverse distance along said flat floor portion being at least equal to said thickness dimension of said elongated member, said second slot being open toward said opposite second side portion of said elongated member, said first and second slots being respectively positioned a dissimilar distance from said first and second ends of said elongated member, said first and second slot flat floor portions lying in planes which intersect said axes of said elongated member.

8. A support structure for a platform comprising:

a. a first elongated member, said first elongated member extending along an axis having a selected length and including a transverse thickness dimension along said axis said first elongated member including first and second opposite side portions extending along said axis, said first and second side portions terminating in first and second ends of said first elongated member, respectively, said first elongated member including a first slot having a flat floor portion and one wall portion, the transverse distance along said flat floor portion being at least equal to said transverse thickness dimension of first each elongated member, said first slot being open toward said first side portion of said first elongated member, said first slot possessing a first depth dimension along said one wall portion thereof relative to said first side portion of said first elongated member, said first elongated member including a second slot having a flat floor portion and one wall portion, the transverse distance along said flat floor portion being at least equal to said thickness dimension of said first elongated member, said second slot being open toward said opposite second side portion of said first elongated member, said second slot possessing a second depth dimension along said one wall portion thereof relative to said second side portion of said first elongated member, said flat floor portions of said first and second slots of said first elongated member each lying along an axis, said first and second slot axes of said first elongated member each lying in plane substantially perpendicular to said flat floor portions of said first and second slots, said planes being substantially non-orthogonally oriented relative to said first elongated member, b. a pair of elongated members, each elongated member of said pair extending along an axis having a selected length and including a transverse thickness dimension along said axis, said each elongated member of said pair including first and second opposite side portions extending along said axis, said first and second side portions terminating in first and second ends of said each elongated member of said pair, respectively, said each elongated member of said pair including a first slot having a flat floor portion and one wall portion, the transverse distance along said flat floor portion being at least equal to said transverse thickness dimension of said each elongated member of said pair, said first slog being open toward said first side portion of said each elongated member of said pair, said first slot possessing a first depth dimension along said one wall portion thereof relative to said first side portion of said each elongated member of said pair, said first slot of each of said pair of elongated members lying along an axis, said first slot axis lying in planes substantially perpendicular to said flat floor portion said first slot of each of said pair of elongated members, said plane of said flat floor portion of first slot of each of said pair of elongated members being non-othogonally oriented relative to said axes of said respective elongated member;

said each elongated member of said pair including a second slot having a flat floor portion and one wall portion, the transverse distance along said flat floor portion being at least equal to said thickness dimension of said each elongated member of said pair, said second slot being open toward said opposite second side portion of said each elongated member of said pair, said second slot possessing a second depth dimension along said one wall portion thereof relative to said second side portion of said each elongated member of said pair, said second slot flat floor portion of said each elongated member of said pair lying along an axis, said second slot axes of each elongated member of said pair lying in planes that are substantially orthogonally oriented relative to each said axis is of each elongated member of said pair.

* * * * *